US005128723A

United States Patent [19]

Bolte et al.

[11] Patent Number: 5,128,723

[45] Date of Patent: Jul. 7, 1992

[54] SCAVENGELESS DEVELOPMENT SYSTEM HAVING TONER DEPOSITED ON A DONER ROLLER FROM A TONER MOVER

[75] Inventors: Steven B. Bolte, Rochester; Grace T. Brewington; Dan A. Hays, both of Fairport; Raymond W. Stover, Webster; William H. Wayman, Ontario, all of N.Y.

[73] Assignee: Xerox Corporation, Stamford, Conn.

[21] Appl. No.: 695,662

[22] Filed: May 6, 1991

[51] Int. Cl.[5] ..... G03G 15/06

[52] U.S. Cl. ..... 355/259; 118/647; 118/654; 355/249; 355/261

[58] Field of Search ..... 355/259, 249, 247, 261, 355/245, 246, 253; 118/651, 653, 654, 647, 661

[56] References Cited

U.S. PATENT DOCUMENTS

| | | | |
|---|---|---|---|
| 4,868,600 | 9/1989 | Hays et al. | 355/259 |
| 4,876,575 | 10/1989 | Hays | 355/259 |
| 4,926,217 | 5/1990 | Bares | 355/253 |
| 4,972,230 | 11/1990 | Wayman | 355/246 |
| 4,990,958 | 2/1991 | Brewington et al. | 355/245 |
| 5,010,367 | 4/1991 | Hays | 355/247 |

*Primary Examiner*—R. L. Moses
*Assistant Examiner*—Sandra L. Brasé
*Attorney, Agent, or Firm*—H. Fleischer; J. E. Beck; R. Zibelli

[57] ABSTRACT

An apparatus which develops an electrostatic latent image recorded on a photoconductive member with toner. Fluidized toner is transported from one end of the developer housing to the other end. An electrical bias is applied between the toner mover and the donor roller so as to attract toner to the donor roller. A rotating rod resiliently urged into contact with the donor roller charges and meters the toner on the donor roller. Electrically biased wires in the development zone between the photoconductive member and the donor roller detach toners from the donor roll so as to form a toner powder cloud in the development zone. Detached toner from the toner powder cloud develops the latent image.

2 Claims, 2 Drawing Sheets

SCAVENGELESS DEVELOPMENT SYSTEM HAVING TONER DEPOSITED ON A DONER ROLLER FROM A TONER MOVER

This invention relates generally to an electrophotographic printing machine, and more particularly concerns a single component development system.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

Single component development systems use a donor roll for transporting charged toner to the development nip defined by the donor roll and photoconductive member. The toner is developed on the latent image recorded on the photoconductive member by a combination of mechanical and/or electrical forces. One type of single component development is scavengeless development. A scavengeless development system uses a donor roll with a plurality of electrode wires closely spaced therefrom in the development zone. An AC voltage is applied to the wires forming a toner cloud in the development zone. The electrostatic fields generated by the latent image attract toner from the toner cloud to develop the latent image. A large continuous supply of toner particles must be available to be capable of copying large numbers of original documents producing multiple copies of the same original document. This is necessary in order to insure that the printing machine is not shut down after relatively short operating intervals due to the lack of toner particles. This is achieved by storing a supply of toner particles in a toner container and dispensing additional toner particles into one end of the developer housing chamber. The toner particles are then transported across the chamber of the developer housing and advanced to the donor roller. However, it has been found that it is frequently difficult to load the donor roller with a sufficient quantity of toner particles uniformly along the length thereof. This has resulted in image defects which degrade the quality of the copy. The following disclosures may be relevant to various aspects of the present invention:

U.S. Pat. No. 4,833,504, Patentee: Parker et al. Issued: May 23, 1989

U.S. Pat. No. 4,868,600, Patentee: Hays et al. Issued: Sep. 19, 1989

U.S. Pat. No. 4,868,611, Patentee: Germain Issued: Sep. 19, 1989

U.S. Pat. No. 4,876,575, Patentee: Hays Issued: Oct. 24, 1989

U.S. Pat. No. 4,990,958, Patentee: Brewington et al. Issued: Feb. 5, 1991

Co-pending U.S. patent application Ser. No. 07/428,726, Applicant: Brewington et al. Filed: Oct. 30, 1989

Co-pending U.S. patent application Ser. No. 07/537,660, Applicant: Brewington et al. Filed: Jun. 14, 1990

The relevant portions of the foregoing disclosures may be briefly summarized as follows:

U.S. Pat. No. 4,833,504 and U.S. Pat. No. 4,868,611 disclose a single pass highlight color printer having a scavengeless developer unit containing a plurality of developer rolls. The developer rolls have rotating non-magnetic cylinders or shells with roughened surfaces and stationary magnets.

U.S. Pat. No. 4,868,600 describes a scavengeless development apparatus in which toner detachment from a donor roll and generation of a controlled powder cloud is obtained by AC electrically biased electrode wires.

U.S. Pat. No. 4,876,575 discloses a donor roll having a rotating metering and charging rod forming a toner metering and charging zone through which toner is moved to simultaneously charge and meter the toner particles. The rod is supported by a distributed bearing attached to a compliant blade. A toner cleaning blade held against the rod serves as a toner seal. The rod is electrically biased.

U.S. Pat. No. 4,990,958 describes a scavengeless development apparatus in which toner detachment from a donor roll and generation of a controlled powder cloud is obtained by AC electrically biased electrode wires. A reload member supported in rubbing contact with an electrically biased toner mover effects reloading of the donor roll with toner. The toner mover serves to transport toner from a remote supply of toner to an area in the opposite the donor roll.

Co-pending U.S. patent application Ser. No. 07/428,726 and co-pending U.S. patent application Ser. No. 07/537,660 describe a development system having a hollow tube having holes therein which fluidizes and moves toner particles from one end of a developer housing to the other end thereof. The tube is electrically biased so that toner particles are attracted from the tube to a donor roller. A charging blade is maintained in contact with the donor roll to charge the toner layer on the donor roller.

In accordance with one aspect of the present invention, there is provided an apparatus for developing a latent image recorded on a surface. The apparatus includes a housing defining a chamber storing a supply of marking particles therein. Means, disposed in the chamber of the housing, fluidize the marking particles. A donor member, spaced from the surface, is adapted to transport marking particles to a development zone adjacent the surface. Means apply an electrical bias between the fluidizing means and the donor member so as to attract fluidized marking particles to the donor member. An electrode member is positioned in the development zone between the surface and the donor member. The electrode member is electrically biased to detach marking particles from the donor member so as to form a cloud of marking particles in the development zone. Detached marking particles from the cloud of marking particles develop the latent image.

Pursuant to another aspect of the present invention, there is provided an electrophotographic printing machine of the type in which an electrostatic latent image recorded on a photoconductive member is developed to form a visible image thereof. The improvement includes a housing defining a chamber storing a supply of toner particles therein. Means, disposed in the chamber of said housing, fluidize the toner particles. A donor member, spaced from the surface, is adapted to transport toner particles to a development zone adjacent the photoconductive member. Means apply an electrical bias between the fluidizing means and the donor member so as to attract fluidized marking particles to the donor member. An electrode member is positioned in the development zone between the photoconductive member and the donor member. The electrode member is electrically biased to detach toner particles from the donor member so as to form a cloud of toner particles in the development zone. Detached toner particles from the cloud of toner particles develop the latent image.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
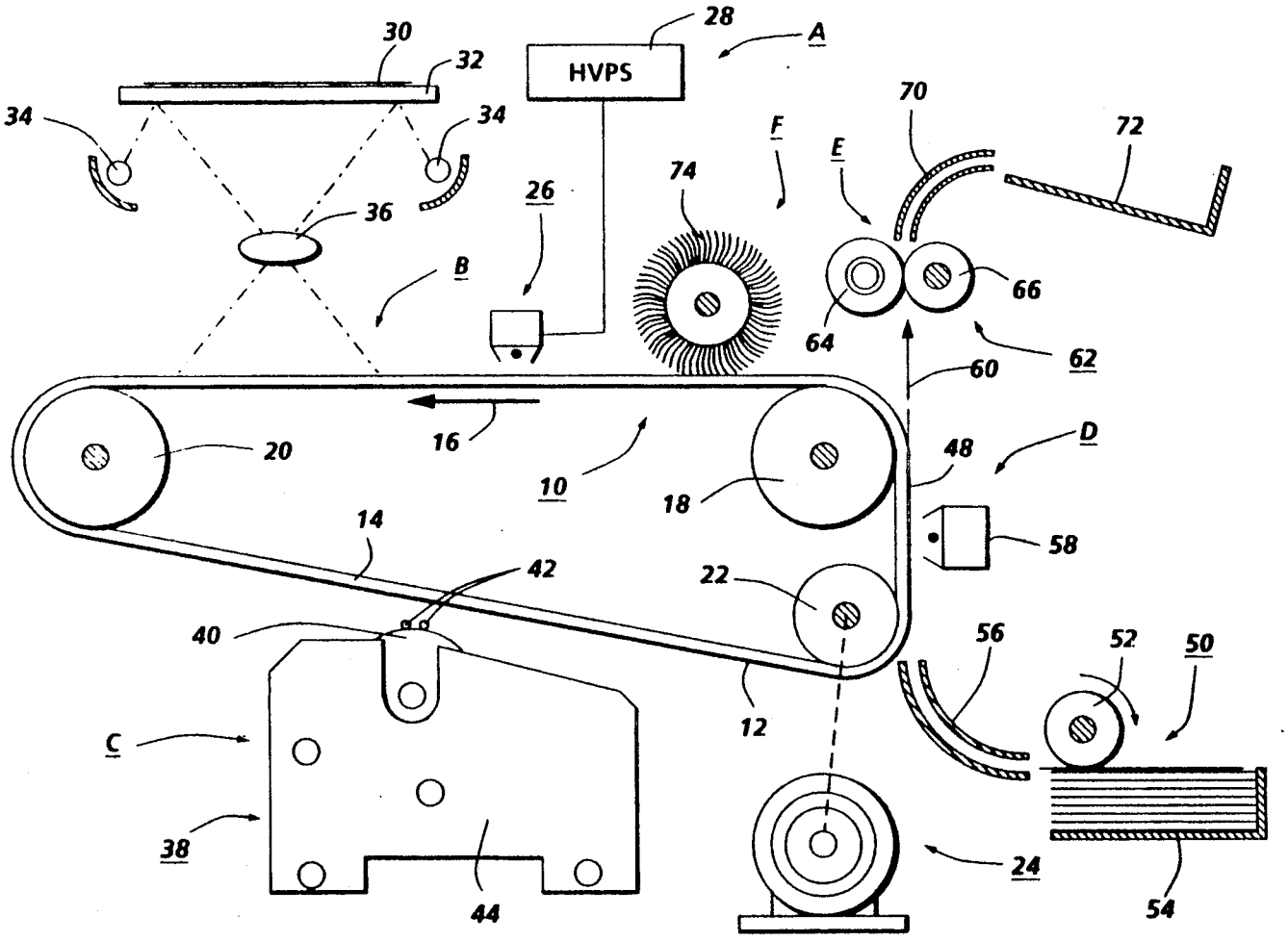
FIG. 1 is a schematic elevational view of an illustrative electrophotographic printing machine incorporating a development apparatus having the features of the present invention therein.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. One skilled in the art will appreciate that any suitable photoconductive belt may be used. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor roller 40 and electrode wires 42. Electrode wires 42 are electrically biased relative to donor roll 40 to detach toner therefrom so as to form a toner powder cloud in the gap between the donor roller and the photoconductive surface. The latent image attracts toner particles from the toner powder cloud forming a toner powder image thereon. Donor roller 40 is mounted, at least partially, in the chamber of developer housing 44. The chamber in developer housing 44 stores a supply of developer material. The developer material is a single component developer material of toner particles. A toner mover disposed interiorly of the chamber of housing 44 conveys the toner from one end of developer housing 44 to the other end thereof. As the toner traverses the developer housing, toner is attracted from the toner mover to the donor roller. The toner mover is electrically biased relative to the donor roller so that the toner particles are attracted from the toner mover to the donor roller. Developer unit 38 will be discussed hereinafter, in greater detail, with reference to FIGS. 2 and 3.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48.

Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
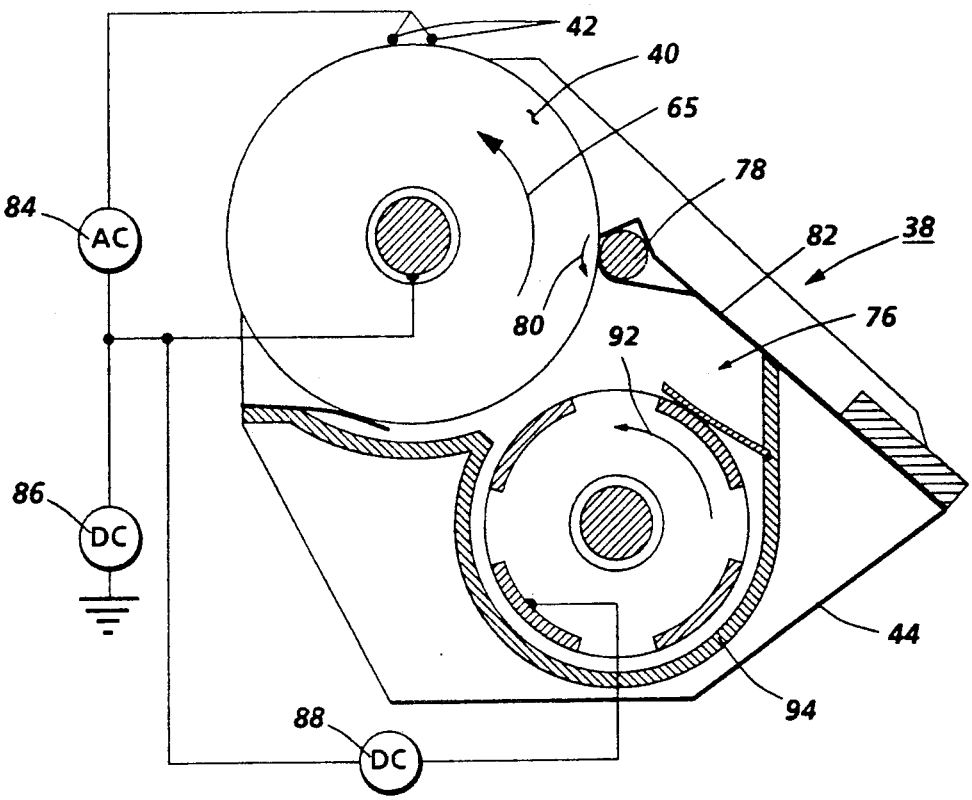
FIG. 2 is an elevational view, partially in section, showing the development apparatus used in the FIG. 1 printing machine.
Figure 3:
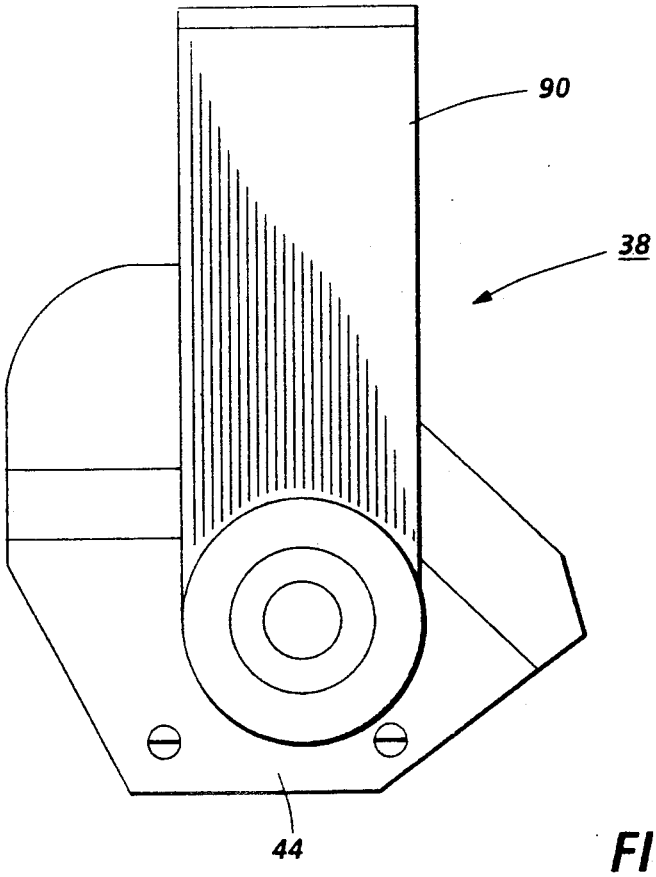
FIG. 3 is a schematic side elevational view of the FIG. 2 development apparatus.

Referring now to FIGS. 2 and 3, there is shown developer unit 38 in greater detail. As shown thereat, developer unit 38 includes a housing 44 defining a chamber 76 for storing a supply of developer material therein. Donor roller 40, electrode wires 42 and toner mover 46 are mounted in chamber 76 of housing 44. The donor roller can be rotated in either the 'with' or 'against' direction relative to the direction of motion of belt 10. In FIG. 2, donor roller 40 is shown rotating in the direction of arrow 68, i.e. the against direction. Similarly, the toner mover 46 can be rotated in either the 'with' or 'against' direction relative to the direction of motion of belt 10. In FIG. 2, toner mover 46 is shown rotating in the direction of arrow 92 i.e. the against direction. A charging rod 78 is resiliently urged into engagement with donor roller 40. Charging rod 78 rotates in the direction of arrow 80. A DC voltage source electrical biases the charging rod relative to the donor roll. A leaf spring 82 supports charging rod 78. The leaf spring 82 is mounted in chamber 76 of housing 44 with the free end rotatably supporting charging rod 78. One skilled in the art will appreciate that any suitable spring may be used to support charging rod 78 and to resiliently urge it into contact with donor roller 40. Leaf spring 82 is preferably made from sheet steel. Charging rod 78 charges the toner particles adhering to donor roller 40 and regulates the thickness of the layer of toner particles on donor roller 40. Preferably, charging rod 78 is made from aluminum having a nickel coating of about 0.013 mm. Donor roller 40 is preferably made from aluminum having a polytetrafluoroethylene based resin of about 0.05 mm coated thereon. Teflon-S, a trademark of the DuPont Corporation is one such suitable resin. This coating acts to assist in charging the toner particles adhering to the surface thereof.

Development system 38 also has electrode wires 42 which are disposed in the space between the belt 10 and donor roller 40. A pair of electrode wires are shown extending in a direction substantially parallel to the longitudinal axis of the donor roller. The electrode wires are made from of one or more thin (i.e. 50 to 100$\mu$ in diameter) metal, e.g. tungsten, wires which are self-spaced from the donor roller by the thickness of the toner on the donor roller.

As illustrated in FIG. 2, an alternating electrical bias is applied to the electrode wires by an AC voltage source 84. The applied AC establishes an alternating electrostatic field between the wires and the donor roller which is effective in detaching toner from the surface of the donor roller and forming a toner cloud about the wires, the height of the cloud being such as not to be substantially in contact with the belt 10. The magnitude of the AC voltage is relatively low and is in the order of 200 to 600 volts peak at a frequency ranging from about 3 KHz to about 20 KHz. A DC bias supply 86 which applies approximately 300 volts to donor roller 40 establishes an electrostatic field between photoconductive surface 12 of belt 10 and donor roller 40 for attracting the detached toner particles from the cloud surrounding the wires to the latent image recorded on the photoconductive surface. At a maximum spacing of about 0.025 mm between the electrode wires and donor roller, an applied AC voltage of 200 to 600 volts produces a relatively large electrostatic field without risk of air breakdown. The use of a dielectric coating on either the electrode wires or donor roller helps to prevent shorting of the applied AC voltage. A DC bias supply 88 which applies approximately 500 to 1000 volts to toner mover 46 establishes an electrostatic field between toner mover 46 and donor roller 40 so that an electrostatic field is established between the donor roller and the toner mover which causes toner particles to be attracted from the magnetic roller to the donor roller. Toner mover 46 fluidizes the toner particles. The fluidized toner particles seek their own level under the influence of the gravity. Inasmuch as new toner particles are being discharged from container 90, located at one end of housing 44 (FIG. 3), into one end of the chamber 78, the force exerted on the fluidized toner particles by the new toner particles being added at that end moves the fluidized toner particles from that end of housing 44 to the other end thereof. Toner mover 46 is an elongated member located in chamber 78 closely adjacent to an arcuate portion 94 of housing 44. Arcuate portion 94 is closely adjacent to elongated member 46 and wraps about a portion thereof. There is a relatively small gap or space between arcuate portion 94 and a portion of elongated member 46. New toner particles are discharged into one end of chamber 78 from container 90. The elongated member is shorter than the donor roll to decrease toner loading on the donor roll at the ends thereof. This alleviates toner head pressure on the end seals. For a design using end feeding of toner, only the non-feed end has the elongated member shorter than the donor roll. The donor roll has detone pads in rubbing contact with the surface thereof to decrease or eliminate the toner loading on the donor roll at the ends thereof. As elongated member 46 rotates in the direction of arrow 92, toner particles are fluidized. A motor (not shown) rotates elongated member 46 at an angular velocity ranging from about 200 to about 600 revolutions per minute with the preferred set point being about 400 revolutions per minute. The force exerted on the fluidized toner particles by the new particles being discharged into chamber 76 advances the fluidized toner particles from the end of the chamber in which the new toner particles have been discharged to the other end thereof. The fluidized toner particles being moved are attracted to donor roller 40. Elongated member 46 is made from an electrically conductive material, such as aluminum. Voltage source 88 is electrically connected to elongated member 46. Elongated member 46 is spaced from donor roller 40 to define a gap therebetween. This gap is preferably about 1.0 mm. Donor roller 40 rotates in the direction of arrow 68 to move the toner particles attracted thereto into contact with the electrostatic latent image recorded on photoconductive surface 12 of belt 10. As donor roller 40 rotates in the direction of arrow 68, charging rod 78 is resiliently urged into contact with donor roller 40. Charging rod 78 is maintained in contact with donor roller 74 at a nominal nip force ranging from about 25 grams per centimeter to about 100 grams per centimeter. The toner particle layer adhering to donor roller 74 is charged to a maximum of 40 microcoulombs/gram with the toner mass adhering thereto ranging from about 0.1 milligrams/centimeter$^2$ to about 2 milligrams/centimeter$^2$ of roll surface. It is thus seen that elongated member 46 continually fluidizes these toner particles. These fluidized toner particles are attracted from elongated member 46 to donor roller 40. Donor roller 40 transports these toner particles in the direction of arrow 68. The toner particles adhering to donor roller 40 have a net charge due to electrostatic selection from the supply of elongated member 46, and are further charged by charging rod 78 prior to advancing into contact with the electrostatic latent image recorded on photoconductive surface 12. These toner particles are attracted to the electrostatic latent image to form a toner powder image on photoconductive surface 12 of belt 10.

As shown in FIG. 2, elongated member 46 includes a hollow rod or tube having four equally spaced rows of apertures or holes therein. Each row of holes is spaced about the periphery of rod by about 90°. Each hole in each row is spaced from the next adjacent hole. The holes are equally spaced from one another. In this way, as the tube rotates, the toner particles travel through the center of the tube and out through the various holes so as to be fluidized. The fluidized toner particles are advanced from one end of the chamber of the developer housing to the other end thereof by the back pressure exerted by the head of fresh or new toner particles being discharged into the chamber from the toner storage container 90 (FIG. 3). Alternatively, elongated member 46 may be a rod having a cylindrical member mounted thereon. The cylindrical member has a plurality of spaced saw tooth shaped paddles extending outwardly therefrom. As elongated member 46 rotates, the paddles agitate and fluidize the toner particles. The toner particles fly off the tips of the saw tooth shaped paddles so as to be fluidized. The pressure or force exerted on the fluidized toner particles by the new toner particles being discharged from toner container 90 (FIG. 3) moves the fluidized toner particles from one end of the chamber 76 (FIG. 2) of housing 44 (FIG. 2) to the other end thereof.

In recapitulation, it is evident that the development apparatus of the present invention includes electrode wires positioned closely adjacent the exterior surface of a donor roller and in the gap defining the development zone between the donor roller and the photoconductive belt. A toner mover fluidizes the toner particles in the chamber of the developer housing. Toner particles being added to the chamber at one end thereof exert a pressure on the fluidized toner particles to move the toner particles from one end of the developer housing chamber to the other end thereof. The toner mover and the donor roller are electrically biased relative to one another so that as the toner particles move from one end of the developer housing to the other end, they are attracted to the donor roller. A rotating charging rod resiliently urged into contact with the donor roller charges the toner particles and regulates the quantity of toner particles on the donor roller. An AC voltage is applied to the electrode wires to detach toner particles from the donor roller so that a toner powder cloud is formed in the development zone. Detached toner particles from the toner powder cloud are attracted to the latent image recorded on the photoconductive belt to develop the latent image.

It is, therefore, apparent that there has been provided in accordance with the present invention, a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An electrophotographic printing machine of the type in which an electrostatic latent image recorded on a photoconductive member is developed to form a visible image thereof, wherein the improvement includes:

a housing defining a chamber storing a supply of toner particles therein;

a doner roller spaced from the photoconductive member and adapted to transport toner particles to a development zone adjacent the photoconductive member;

a rotatably mounted elongated member disposed in the chamber of said housing in the region of said doner roller;

means for applying an electrical bias between said elongated member and said doner roller so as to attract fluidized toner particles to said doner roller;

means for charging and metering the quantity of toner particles being advanced by said doner roller to the electrostatic latent image recorded on the photoconductive member, said charging and metering means comprising a rotating rod, and means for resiliently urging said rod closely adjacent to said doner roller;

a plurality of small diameter wires positioned in the development zone between the photoconductive member and the said doner roller; and means for electrically biasing said electrode wires to detach toner particles from said doner roller so as to form a cloud of toner particles in the development zone with detached toner particles from the cloud of toner particles developing the latent image.

2. A printing machine according to claim 1, further including means for discharging additional marking particles into the chamber of said housing with the marking particles being discharged into the chamber exerting a pressure on the fluidized marking particles to move the fluidized marking particles from one end of said housing to the other end thereof.

* * * * *